United States Patent [19]

Loprete

[11] Patent Number: 4,995,791

[45] Date of Patent: Feb. 26, 1991

[54] REFRIGERANT GAS COMPRESSOR UNIT

[75] Inventor: Joseph F. Loprete, Bristol, Tenn.

[73] Assignee: Bristol Compressors, Inc., Bristol, Va.

[21] Appl. No.: 276,020

[22] Filed: Nov. 25, 1988

[51] Int. Cl.[5] ..... F04B 39/06

[52] U.S. Cl. ..... 417/366; 417/902

[58] Field of Search ..... 417/312, 313, 366, 902, 417/295; 62/296; 184/6.23

[56] References Cited

U.S. PATENT DOCUMENTS

| | | | |
|---|---|---|---|
| 4,147,479 | 4/1979 | Morse | 417/902 X |
| 4,470,772 | 9/1984 | Gannaway | 417/902 X |
| 4,486,153 | 12/1984 | Romer et al. | 417/313 |
| 4,850,816 | 7/1989 | Kosfeld | 417/313 |

FOREIGN PATENT DOCUMENTS

| | | | |
|---|---|---|---|
| 60-119397 | 6/1985 | Japan | 417/366 |
| 63-285286 | 11/1988 | Japan | 417/371 |

*Primary Examiner*—Leonard E. Smith
*Assistant Examiner*—Eugene L. Szczecina, Jr.

[57] ABSTRACT

A refrigeration gas compressor unit having a casing, an electric motor driven compressor mounted in the casing, a housing containing and substantially isolating the inner cavities or passages of the motor from the casing cavity, refrigerant suction port in the casing, a primary-feed conduit connecting the suction port to the intake of the compressor, a secondary-feed conduit connecting the suction port to the primary-feed conduit and in part consisting of the passages between the housing, rotor and stator of the electric motor, a refrigerant flow control associated with the secondary-feed conduit for regulating the flow of refrigerant therethrough, and a refrigerant discharge port in the casing communicating with the compression chamber of the compressor.

8 Claims, 4 Drawing Sheets

REFRIGERANT GAS COMPRESSOR UNIT

This invention concerns a gas compressor unit of the type employed for refrigeration or air-conditioning systems, wherein the unit is electrically powered and hermetically sealed, and particularly concerns novel structural design which affords substantial improvements in operating characteristics such as compressor longevity and efficiency.

Such compressor units as employed, for example, in central air conditioners and window unit air conditioners, are required to provide highly compressed refrigerant gas in a thermodynamically efficient manner while providing the necessary cooling of their motors, compressors, and other parts, by virtue of their own structural designs and the thermodynamics of their associated closed-loop systems.

It is known, in a general way, to employ the refrigerant itself, or the oil of the compressor to cool the electric motor, as taught in U.S. Pat. Nos. 2,963,216; 3,270,952; 3,663,127; 3,698,839; and 4,470,772. In the units of these patents, the return or suction refrigerant, or the oil is caused to flow around various portions of the motor to cool the same. These disclosures are exemplary of the structures and of the gas flow or oil flow patterns which have been worked out in an attempt to provide proper motor cooling. In general, and as will become more evident from the discussion below, excessive heating of the suction cooling gas typically occurs with these prior systems through contact with high temperature parts of the compressor or the hot oil. The interactions of compressor structure and operation are thus extremely complex and have given rise to a wide variety of structural concepts, as exemplified in the aforesaid patents, in attempts to achieve the principal desirable operating characteristics of high compressor and overall system efficiency while providing adequate motor cooling.

These prior compressor unit designs have had only limited success in attaining those goals, particularly with respect to maintaining the compressor feed gas at a sufficiently low temperature to provide a molecular density of the gas sufficiently high to allow proper compressor and overall system efficiency. Some of the reasons for the limited efficacy of such prior compressor designs will become evident from comparisons made below with respect to the present invention.

It is a general object therefore, of the present invention to provide a compressor unit construction which provides excellent control of motor temperature while affording the aforesaid desirable operating characteristics, without the need for complex, expensive structure.

Another and more specific object of the invention is to provide in a refrigerant compressor unit, a return or suction gas circulation means which is capable of limiting or regulating the suction gas flow around and through the electric motor such that only a minor part of the suction gas is used to cool the motor such that the exit gas temperature is approximately the same as the surrounding temperature and little if any, heat is added thereto. The cooling gas is then mixed with the direct suction gas flow and the resultant temperature thereof remains cool.

Another object of the invention is to provide the aforesaid circulation means with positive gas transfer means for moving the cooling gas at a desirable and regulatable rate through the motor passages and then causing it to intimately intermix with the main suction gas stream.

A further object is to provide the aforesaid circulation means whereby essentially only electric motor heat is picked up by the cooling gas and the high temperatures of the crank case oil and compressor head are essentially avoided.

These and other objects hereinafter appearing have been attained in accordance with the present invention which is defined in its broad sense as a refrigeration gas compressor unit comprising a casing, an electric motor driven compressor mounted in said casing, a housing containing and substantially isolating the inner cavities or passages of the motor from the casing cavity, refrigerant suction port means in said casing, primary-feed conduit means connecting said suction port means to the intake of said compressor, secondary-feed conduit means connecting said suction port means to said primary-feed conduit means and comprising the passages between the housing, rotor and stator of said electric motor, refrigerant flow control means associated with said secondary-feed conduit means for regulating refrigerant flow therethrough, and refrigerant discharge port means in said casing communicating with the compression chamber of said compressor.

In certain preferred embodiments of the invention:

The refrigerant flow control means allows between about 15% to about 40% by weight of the intake refrigerant to pass through the secondary-feed conduit means;

The secondary-feed conduit means is substantially thermally isolated from the casing cavity, compressor head, compressor oil sump, and hot compressor oil;

Liquid-gas separator means is provided in the suction conduit system of the unit;

The said flow control means is a thermostatically controlled valve;

The said flow control means includes pressure drop means from said secondary feed conduit means to said primary-feed conduit means;

The said pressure drop means comprises venturi means in said primary-feed conduit means in close proximity to the compressor intake; and The said thermostatically controlled valve is motor temperature responsive to allow increased refrigerant flow as motor temperature increases.

As indicated above, the cited prior cooling system designs lack one or more of such structural features as primary and secondary suction gas feeds, isolation of cooling gas from crankcase oil and compressor head, means to regulate the volume or proportion of the cooling gas, and positive gas transfer means for insuring adequate and controlled flow of cooling gas completely through the motor with subsequent intimate mixing with the primary feed gas.

These and other important differences between the prior compressor designs and the present invention will become apparent from the following description and drawings wherein.

Figure 1:
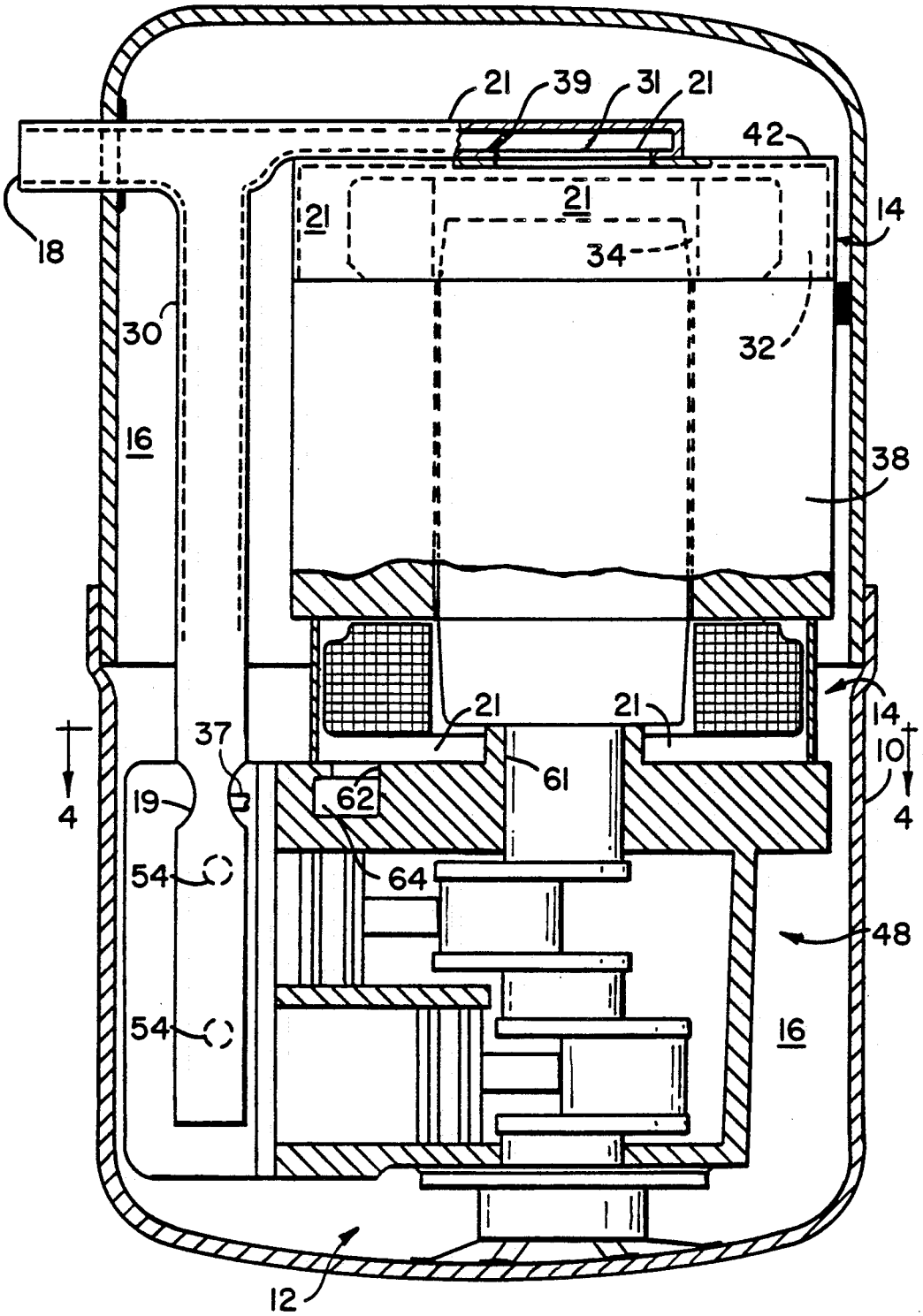
FIG. 1 is a side view, partially in section of a compressor unit embodying the present invention.

Referring to the drawing, the dual piston compressor unit shown therein for exemplary purposes only, comprises a casing 10, an electric motor driven compressor generally designated 12 mounted in said casing, a housing generally designated 14 containing and substantially isolating the inner cavities and passages of the motor from the casing cavity 16, refrigerant suction port means 18 in said casing, primary-feed conduit means 30 connecting said suction port means to the intake of said compressor, refrigerant flow control means comprising any one or any combination of flow assist or flow inhibiting means such as venturi means 19 or equivalent orifice means in the primary-feed conduit means, or valve means 39 or aperture means 28 in the secondary-feed conduit means 21 connecting said suction port means to said primary-feed conduit means, said secondary-feed conduit means further comprising the passages 31, 32, 34 and the like between the housing 14, rotor 36 and stator 38 of said electric motor, the connecting passage 37 and the conduit segment 64, and refrigerant discharge port means 40 in said casing communicating with the compression chamber of said compressor.

Figure 2:
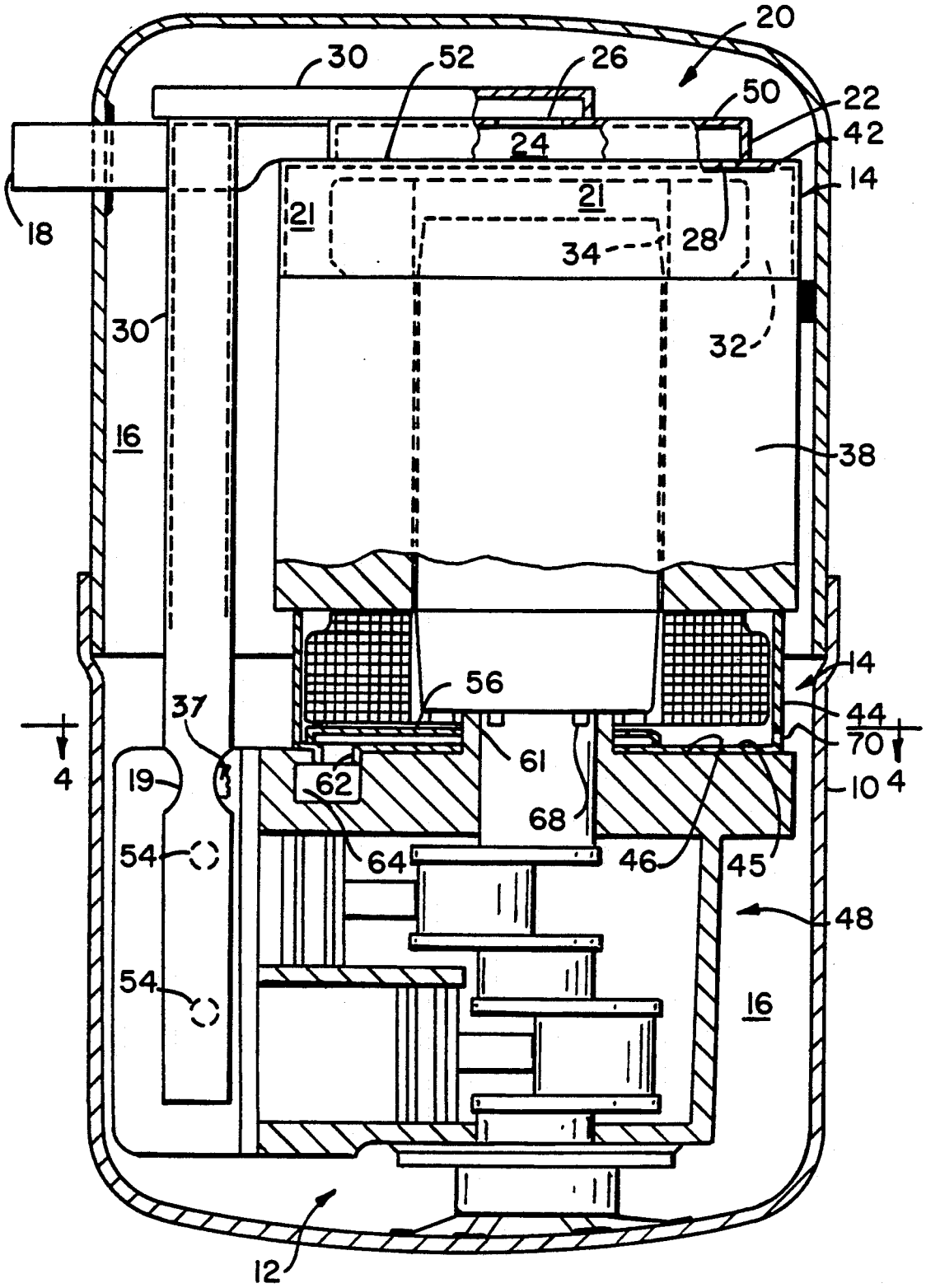
FIG. 2 is a side view, partially in section of a compressor unit as in FIG. 1 provided with a liquid-gas separator means and embodying the present invention.
Figure 4:
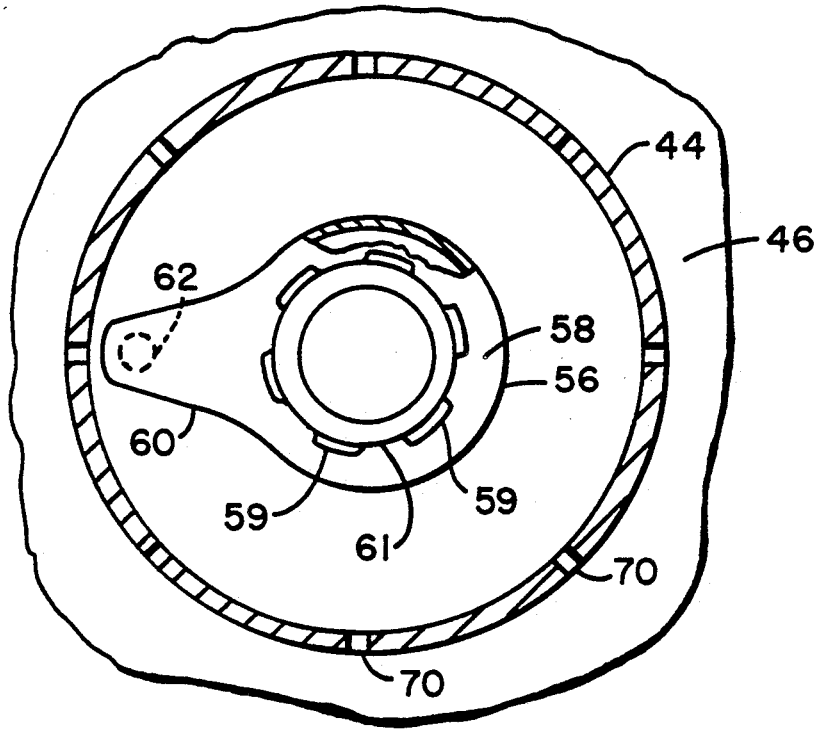
FIG. 4 is a partial sectional view of the unit taken along line 4—4 of FIG. 2 in the direction of the arrows.
Figure 3:
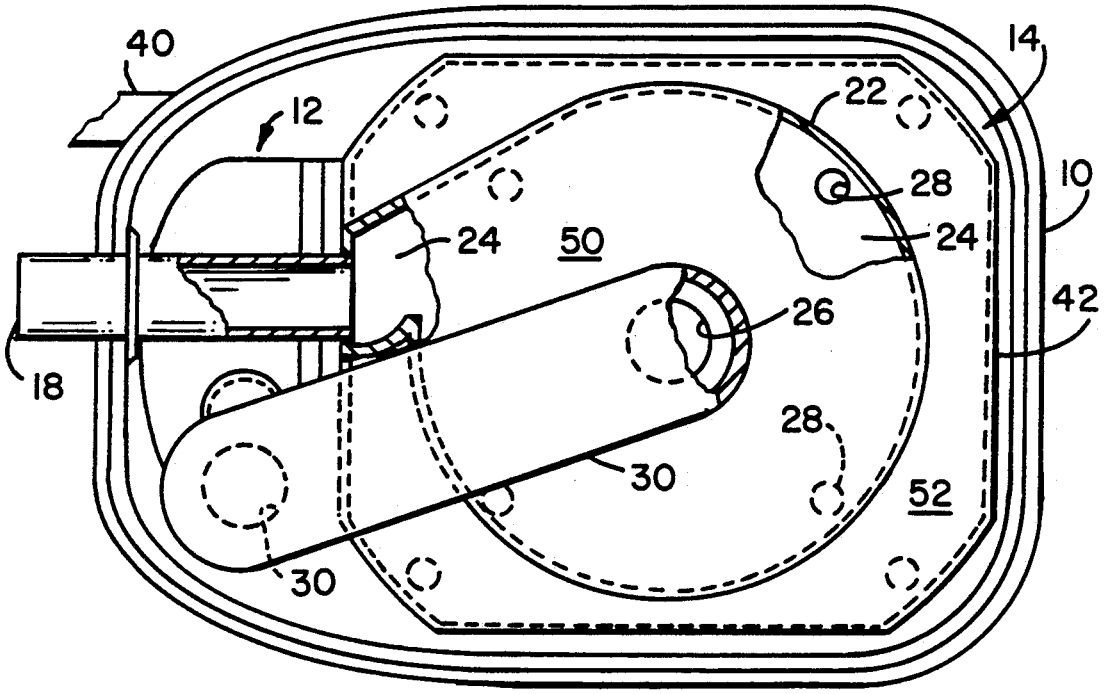
FIG. 3 is a vertically downward view of the unit of FIG. 2 with the top of the casing removed to show the arrangement of the liquid-gas separator means partially in section and provided with a thermostatically controlled, gas flow control valve.

Referring further to the drawings with particular reference to FIGS. 2–4 wherein structural elements equivalent to those of FIG. 1 are similarly numbered, the unit is provided with stationary liquid-gas separator means generally designated 20 in said casing comprising wall means 22 defining a generally circular chamber 24 communicating substantially tangentially with said suction port means, primary outlet means 26 in a radially central portion of said separator means and secondary outlet or aperture means 28 in peripheral portions thereof, and wherein the primary-feed conduit means 30 connects said primary outlet means to the intake of said compressor, and the secondary-feed conduit means connects said secondary outlet means to the primary-feed conduit means at said venturi means.

The general construction of the compressor unit casing, electric motor, compressor, and other typically employed components can be of any conventional type, such as shown for example in the aforesaid U.S. Patents and others such as U.S. Pat. Nos. 3,081,935 and 3,104,051, the disclosures of all of which are incorporated herein by reference. As will hereinafter become evident, modifications of these prior units can readily be made by one skilled in the art in accordance with the present specification and drawings, in order to accommodate the present invention.

Referring further to FIGS. 2–4 of the drawings, a top cover 42 is provided to cover the upper end of the motor, and a bottom cover or shroud 44 covers the lower end of the motor. This shroud may be conveniently formed in one piece and clamped between the stator 38 and the top 46 of the compressor shell generally designated 48. These covers, in cooperation with the stator itself provide the housing 14 which substantially isolates or seals the aforementioned motor inner cavities or passages such as 32 and 34 from the compressor unit casing cavity 16 and thereby allows directional control of refrigerant flow in accordance with the present invention as will be explained in greater detail below.

The liquid-gas separator generally designated 20 of cap-like configuration, comprises the generally circular wall 22 and top 50 providing the chamber 24, is affixed in any suitable manner such as welding or brazing to the top 52 of cover 42 when these components are metal, and by snap-in tabs or plastic fusion (welding) or the like when the components are of plastic material such as Nylon, cellulose acetate butyrate, polyester, or polycarbonate. The term "generally circular" as used herein means a configuration such as a circle, ellipse or the like which can direct the refrigerant flow in a centrifugal or swirling manner. The suction port means or tube 18 is sealed into an opening in wall 22 in a substantially tangential manner such as to cause the incoming liquid-gas return refrigerant to flow in a vortex-like manner and throw the heavier liquid radially outwardly toward wall 22. An aperture 26 in the cover 50 of the separator provides the primary outlet means and enters into conduit 30 affixed to top 50 to provide the primary-feed conduit means which is fixed at its lower end to a portion of the compressor so as to communicate with the intake valving 54 or other such intake porting system thereof to supply separated gas thereto. A plurality of apertures 28 in the top 52 of cover 42 are suitably placed as desired to overlie end portions of the stator core, windings or even further radially inwardly adjacent the rotor-stator gap, to allow the downward flow of separated liquid through motor passages and cavities such as 32 and 34 to thereby provide, in conjunction with said passages, the secondary-feed conduit means for cooling the motor.

In accordance with the present invention and as indicated above, these apertures 28 can serve as the sole refrigerant flow control means and for this purpose may be suitably sized to allow a predetermined amount, preferably between about 15% to about 40%, most preferably from about 19% to about 35% by weight of the intake refrigerant to pass through the secondary-feed conduit means during normal compressor operation after start and warm-up.

Figure 5:
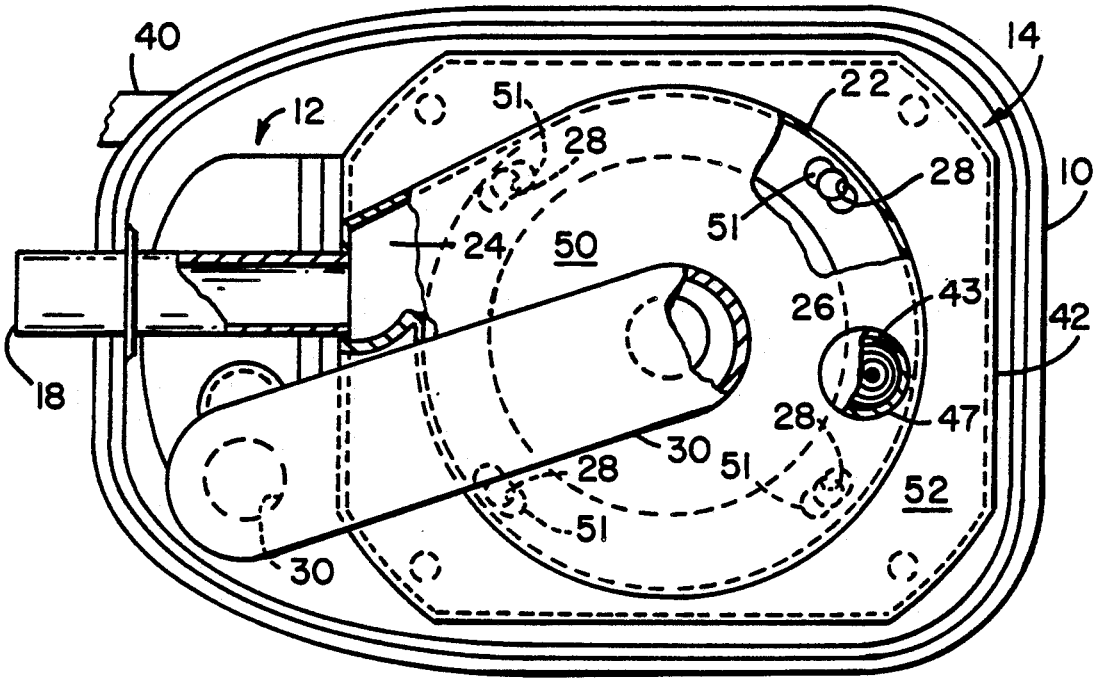
FIG. 5 is a view as in FIG. 3 wherein the flow areas of apertures 28 are controlled by a thermostatically controlled, rotational sliding disc valve.
Figure 6:
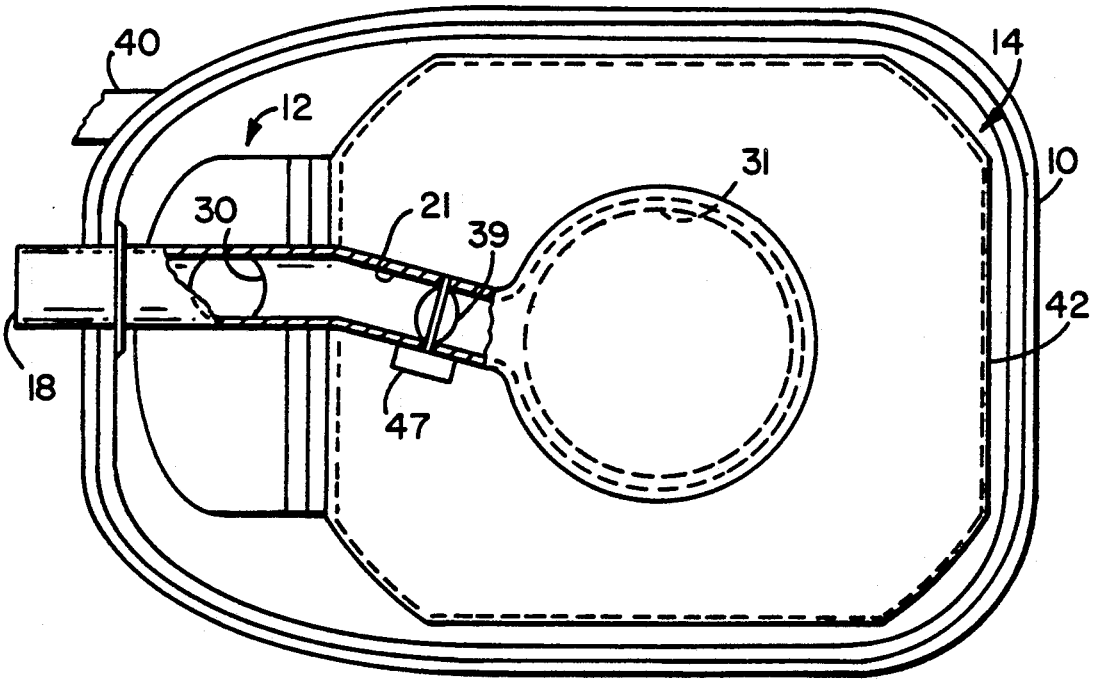
FIG. 6 is a top elevational view of the suction conduit system taken along line 6—6 of FIG. 1 in the direction of the arrows.

A variation of the means for adjusting the flow areas of apertures 28 is shown in FIG. 5 wherein a circular valve disc or ring 29 having slots 51 is rotatably, slidably mounted on the top 52 of the cover 42 and is connected to a temperature responsive force generator such as the the metal coil 43 of a thermostat 47 mounted on cover 50 such that upon sensing an increase or decrease in motor temperature, the generator will react to rotate the ring to a more open or closed position respectively with respect to apertures 28. In this manner the motor temperature can be carefully controlled and provides the very significant advantage of employing only as much intake refrigerant to cool the motor as is necessary. This type of control will keep the warm-up of suction refrigerant passing to the compressor intake to a minimum. As a consequence, the motor cooling refrigerant does not have to be dumped to the cavity 16 with attendant loss of overall compressor efficiency.

In a similar manner to apertures 28, the valve 39 as shown in FIG. 1 can be regulated by a thermostatic coil to function as the sole refrigerant flow control means or it can serve as a fixed, predetermined restriction to flow. The venturi 19 is one of the most effective means for controlling refrigerant flow through the secondary-feed conduit means, particularly in combination with predetermined orfice means such as apertures 28. The venturi dimensions can readily be determined from desired flow rate and compressor performance and temperature data. The venturi can function as a positive gas transfer means while controlling the rate of flow of the cooling gas by way of its predetermined size and thermodynamic design, i.e., its developed pressure differential under operating conditions.

Referring particularly to FIG. 4, positioned on the floor 45 of shroud 44 and secured thereto in substantially sealing contact therewith is a gas inlet plenum 56 having an upper surface 58 for liquid run-off, gas inlet ports 59 spaced around the shaft bearing 61, and a gas transfer conduit 60 having bottom outlet 62 communicating with a suitable conduit segment such as internal passage 64 conveniently formed by casting or machining into the compressor shell 48. This segment is connected into the venturi 19, thereby completing the secondary-feed conduit means. It is noted that passage 64 may equally well constitute an opening through the shroud 44. The end of the rotor is provided with a plurality of fins 68 which fling liquid refrigerant and any oil which is present outwardly toward a plurality of drain ports 70 spaced around the bottom edge of shroud 44. It is particularly noted that ports 59 are radially inboard of fins 68 and are thus essentially inaccessible to liquid materials flowing downwardly between the rotor and stator.

The operating conditions of the present unit in regard to refrigerant type and charge, oil level, compressor motor speed, and the like are conventional. The present construction gives many advantages, some of which are not readily apparent, and include the use of the vaporization of liquid refrigerant fed from the separator to the secondary-feed conduit for cooling the motor, the gas thus formed then being fed to the compressor intake while the remaining liquid is separated out and drained to the sump.

The invention has been described in detail with particular reference to preferred embodiments thereof, but it will be understood that variations and modifications will be effected within the spirit and scope of the invention.

I claim:

1. A gas compressor unit comprising a casing, an electric motor driven compressor mounted in said casing, a housing containing the inner cavities or passages of the motor, refrigerant suction port means in said casing, primary-feed conduit means connecting said suction means to the intake of said compressor, secondary-feed conduit means including said housing and connecting said suction port means to said primary-feed conduit means, refrigerant flow control means associated with said secondary-feed conduit means for regulating refrigerant flow therethrough, said flow control means provides a pressure drop from said secondary-feed conduit means to said primary-feed conduit means, and refrigerant discharge port means in said casing communicating with the compression chamber of said compressor.

2. The unit of claim 1 wherein said secondary-feed conduit means is substantially thermally isolated from the casing cavity, compressor head, compressor oil sump, and hot compressor oil.

3. The unit of claim 1 wherein said refrigerant flow control means allows between about 15% to about 40% by weight of the intake refrigerant to pass through the secondary-feed conduit means.

4. The unit of claim 1 wherein said refrigerant flow control means allows between about 19% to about 35% by weight of the intake refrigerant to pass through the secondary-feed conduit means.

5. The unit of claim 1 wherein liquid-gas separator means is provided in the suction conduit system thereof.

6. The unit of claim 1 wherein said flow control means is a thermostatically controlled valve.

7. The unit of claim 1 wherein said flow control means comprises the combination of predetermined aperture means in said secondary-feed conduit means, and venturi means in said primary-feed conduit means at the point of connection to said secondary-feed conduit means.

8. The unit of claim 6 wherein said valve is motor temperature responsive to open further as motor temperature increases.

* * * * *